US007868557B2

(12) United States Patent
Deurenberg et al.

(10) Patent No.: US 7,868,557 B2
(45) Date of Patent: Jan. 11, 2011

(54) CONTROLLING AN ARRANGEMENT OF SEMICONDUCTORS EMITTING LIGHT OF DISTINCT COLORS

(75) Inventors: Peter Hubertus Franciscus Deurenberg, Eindhoven (NL); Eugen Jacob De Mol, Varginha (BR); Jacobus Henricus Peter Martinus Vinken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 544 days.

(21) Appl. No.: 11/915,024

(22) PCT Filed: May 19, 2006

(86) PCT No.: PCT/IB2006/051597

§ 371 (c)(1),
(2), (4) Date: Nov. 20, 2007

(87) PCT Pub. No.: WO2006/126151

PCT Pub. Date: Nov. 30, 2006

(65) Prior Publication Data

US 2008/0203927 A1 Aug. 28, 2008

(30) Foreign Application Priority Data

May 27, 2005 (EP) ..... 05104545

(51) Int. Cl.
*H05B 37/02* (2006.01)

(52) U.S. Cl. ..... 315/149; 315/152; 315/307; 315/360

(58) Field of Classification Search ..... 315/149–152, 315/155–159, 291, 294, 295, 307–308, 360
See application file for complete search history.

(56) References Cited

U.S. PATENT DOCUMENTS

| | | | | |
|---|---|---|---|---|
| 6,127,783 | A * | 10/2000 | Pashley et al. | 315/149 |
| 6,441,558 | B1 | 8/2002 | Muthu et al. | |
| 6,488,390 | B1 | 12/2002 | Lebens et al. | |
| 7,045,974 | B2 * | 5/2006 | Lin et al. | 315/308 |
| 7,173,383 | B2 * | 2/2007 | Vornsand et al. | 315/291 |
| 7,375,472 | B2 * | 5/2008 | Wong et al. | 315/307 |
| 7,462,997 | B2 * | 12/2008 | Mueller et al. | 315/312 |
| 7,626,339 | B2 * | 12/2009 | Paton | 315/155 |
| 2005/0093488 | A1 * | 5/2005 | Hung et al. | 315/307 |

FOREIGN PATENT DOCUMENTS

| | | | |
|---|---|---|---|
| EP | 1339 263 | A1 | 8/2003 |
| WO | 0247438 | A2 | 6/2002 |
| WO | 02052902 | A2 | 7/2002 |
| WO | 2004100611 | A1 | 11/2004 |

OTHER PUBLICATIONS

Subramanian Muthu et al: "Red, Green and Blue Led Based White Light Generation", IEEE Publications, pp. 327-333, 2002.
Subramanian Muthu et al: "Red, Green and Blue Leds for White Light Illumination", IEEE Journal On Selected Topics In Quantum Electronics, vol. 8, No. 2, 2002.

* cited by examiner

*Primary Examiner*—Douglas W Owens
*Assistant Examiner*—Tung X Le

(57) ABSTRACT

Controlling an arrangement of semiconductors of which different semiconductors emit light of different distinct colors is disclosed, whereby a feed forward control part, which is dependent on a junction temperature of semiconductors for each color, is operated with first intervals and is adjusted dependent on measure light output for each color with much longer second intervals.

10 Claims, 2 Drawing Sheets

CONTROLLING AN ARRANGEMENT OF SEMICONDUCTORS EMITTING LIGHT OF DISTINCT COLORS

FIELD OF THE INVENTION

The invention relates to a method for controlling an arrangement of light emitting semiconductors emitting light of substantially distinct colors. The invention also relates to a lighting system according to the preamble of claim 6.

BACKGROUND OF THE INVENTION

U.S. Pat. No. 6,441,558 discloses a LED luminary system for providing power to LED light sources to generate a desired light color. The system comprises a controller for controlling a supply or power to the LEDs. The controller comprises two parts. The first part measures a temperature of the arrangements of LEDs, it determines a junction temperature of the semiconductors for each distinguished color, and it determines a feed forward junction temperature compensation to provide an intermediate control signal which is supplied to a lumen output module, emitting a wanted output power or lumen output for each color. A second part of said controller comprises a feedback loop, which receives the output of the lumen output module as a set point value. A light output is measured and a measured value is subtracted from the set point value provided by the lumen output module to provide a difference or error signal. The error signal is supplied to a lumen output controller, which adjusts a pulse width modulation (PWM) of power supplied to LEDs of the corresponding distinct color. Thus, the first, feed forward junction temperature dependent part and the second, lumen feedback part are connected in series. With such a controller the output of emitted light is controlled to be identical to a set point value supplied by the lumen output module of the feed forward part.

A controller, which provides feed forward junction temperature compensation only, can be used to compensate for differences of light output and wavelengths shifts due to changes of junction temperature(s).

A controller, which comprises a lumen feedback to control a lumen or light output only to be identical to some set point value, could be used to compensate for changes of light output due to temperature effects and aging of the LEDs.

The prior art controller comprises an algorithm for the feed forward part and the feedback part, which includes many calculation steps. The temperature of the LED arrangement may vary rather fast, and, as a consequence, light output power and wavelengths shift also. Therefore the calculation of such algorithm must be carried out with a high pace, which, in practice, is identical to a pulse width modulation period at which a supply to the LEDs is modulated. To avoid visible flickering in the light output of the module, the pulse width modulation period is usually shorter than 20 milliseconds. As a consequence, a processor for carrying out said calculation must be powerful and therefore will be expensive. A complicating factor is that when using a single light sensitive element to measure the light output of each color, it is required to time shift the on-time for each color. It also requires the use of a minimum on time for each color during each PWM period, so that the combined light output of all colors always contains a fraction of each color. To minimize such fractions and thereby maximizing the control range of light output for each color, the light output for each color must be sensed and evaluated even faster, which requires an even more powerful and expensive processor.

The inventors found that compensating the light output for changes due to aging need not to be carried out with such high pace. In addition, the inventors conceived that an output of a feed forward junction temperature compensating part should not be used as such to provide a set point for the wanted light output.

OBJECT OF THE INVENTION

It is an object of the invention to solve the drawbacks of the prior art as described above and to provide improvements in compensating for changes of light output of emitted light for each distinguished color and wavelengths shifts dependent on changes of junction temperature of the semiconductors and, in combination, compensate for changes of emitted light power due to aging.

SUMMARY OF THE INVENTION

The above object of the invention is achieved by providing a method as described in claim 1.

With the method as claimed, calculations, which are required to compensate for changes of light output due to aging, can be carried out with very long intervals in a range of hundreds or thousands of hours. As a consequence the processor for carrying out all calculations can be less powerful and therefore much cheaper than before. Because of said long intervals a period for sensing and processing emitted light need not to be as short as before and need not to fall within a single PWM period. This allows for using less expensive light sensing elements.

The object of the invention is also achieved by providing a lighting system as described in claim 6.

BRIEF DESCRIPTION OF THE DRAWINGS

The invention will become more gradually apparent from the following exemplary description in connection with the accompanying drawing. In the drawing.

DETAILED DESCRIPTION OF EXAMPLES

Figure 1:
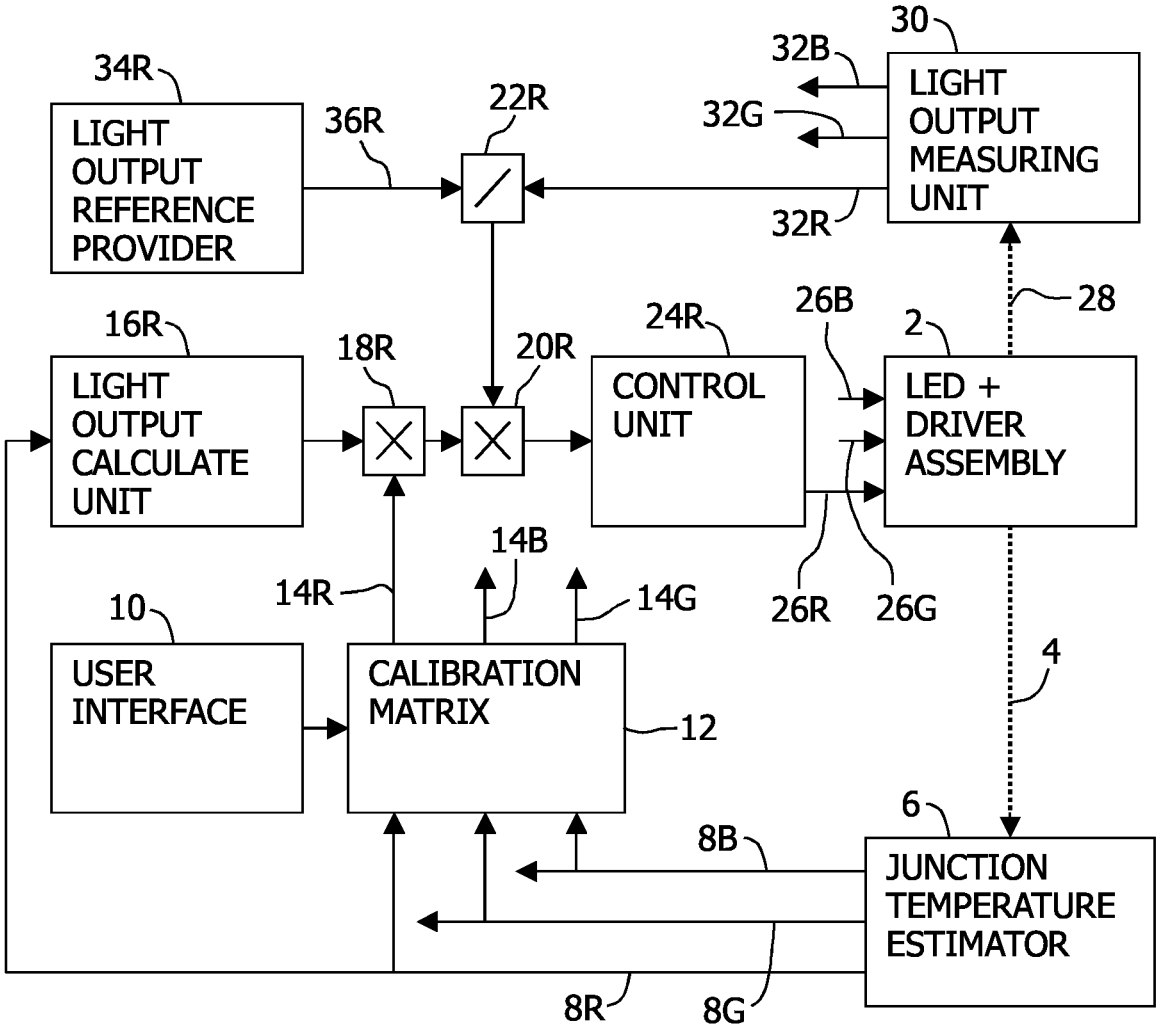
FIG. 1 shows a diagram of a first embodiment of a lighting system according to the invention.

The lighting system shown in FIG. 1 comprises an assembly 2 of an arrangement of light emitting semiconductors, such as diodes (LEDs), and drivers for driving the semiconductors from a power supply. The arrangement of semiconductors comprises semiconductors for emitting light of different distinct colors. As an example, but not limited to that, three different colors can be used, in particularly red, green and blue, which, abbreviated to R, G and B respectively, are used as a suffix to numerals for referring to parts and signals of the system.

At some locations, such as a heat sink, of the arrangement of semiconductors a temperature is measured, which is indicated by dotted arrow 4. A junction temperature estimator 6 uses a value of the sensed temperature to determine a junction temperature 8R, 8G and 8B of each color. The estimator 6 comprises a thermal model of a luminary containing the arrangement of light emitting semiconductors. The use of such estimator is known per se and therefore a detailed description thereof will be omitted here.

A user interface 10 provides means for a user of the lighting system to set a wanted light output as emitted by the semiconductors of all colors, that is, with wanted intensities of light of each color and, consequently, a wanted ratio of such intensities. To that extent, input provided by the user via interface 10, is supplied to a calibration matrix 12. The calibration matrix 12 outputs a nominal value of the wanted intensities, as indicated by numerals 14R, 14G and 14B. The actual output of light is dependent on the junction temperature of the semiconductors. Therefore the estimated junction temperatures 8R, 8G and 8B are supplied to the calibration matrix 12 to compensate the nominal values 14R, 14G and 14B respectively for changes of the junction temperature for the respective distinct color. This allows compensation for wavelength shifts due to changes in junction temperature.

In the drawings, parts, which are identical for each distinct color, are shown only for one distinct color, which is red in the example. A light output calculation unit 16R receives the junction temperature value 8R and calculates a light output factor in accordance with, for instance, formula: $EXP((T_{j,R}-T_{ref,R})/T_{0R})$ is:

$T_{j,R}$ is the estimated junction temperature of the semiconductors emitting red light;

$T_{ref,R}$ is a is a reference temperature at which the output of the red semiconductors is specified;

$T_{0R}$ is a characteristic value, which can describe a light output (e.g. flux) output of the red semiconductors dependent on junction temperature.

Said formula is known per se and is given as an example only.

A first multiplier 18R multiplies the nominal value 14R, received from the calibration matrix 12 and an output from the light output calculation unit 16R. The output of multiplier 18R determines a pulse width during which the semiconductors of the corresponding distinct color (red in this case) are supplied with power. By using the light output calculation unit 16R and using the junction temperature 8R, changes in the emitted light, by any cause, can be compensated.

A second multiplier 20R receives an output from the first multiplier 18R and an output from a divider 22R. A control unit 24R receives an output from the second multiplier 20R and dependent on that it controls the width of pulses during which the semiconductors are to be supplied with power. To that extent, the control unit 24R supplies a pulse width modulated signal 26R to the semiconductor and driver assembly 2.

Light emitted by the semiconductors is indicated by dotted arrow 28 and its light output is measured by a light output measuring unit 30. The light output measuring unit 30 can comprise a distinct sensor for each distinct color of light emitted by the semiconductors. As an alternative a single sensor can be used in combination with a timing by which each color is measured during different intervals. The light output measuring unit 30 outputs light output values 32R, 32G and 32B for the distinct colors respectively. A light output reference provider 34R outputs a light output reference 36R for each distinct color. The divider 22R divides the light output reference value 36R by the measured light output value 32R and it outputs the light output ratio thus calculated to the second multiplier 20R.

The light output reference values are set for a specific reference junction temperature.

Calculations involved with said operations of the junction temperature estimator 6, the calibration matrix 12, the light output calculation unit 16R, the first multiplier 18R and the second multiplier 20R are carried out with a first interval of, for example, twenty milliseconds.

Calculations involved with the operation of the divider 22R and the operation of the light output measuring unit 30 and light output reference provider 34R are carried out with a second interval, which is, for example, in a range of 100 to 10000 hours. During the second interval an output from the divider 22R is retained, so that it can be used by the first multiplier 20R during each first interval.

By using the light output measuring unit 30, the light output reference provider 40R, the divider 22R and the multiplier 20R it is possible to compensate for changes in light output caused by aging of the semiconductors. Since aging semiconductors is a slow process compensation may be carried out with said long second intervals, which allows the use of a less powerful processor to carry out calculations during each first interval.

Figure 2:
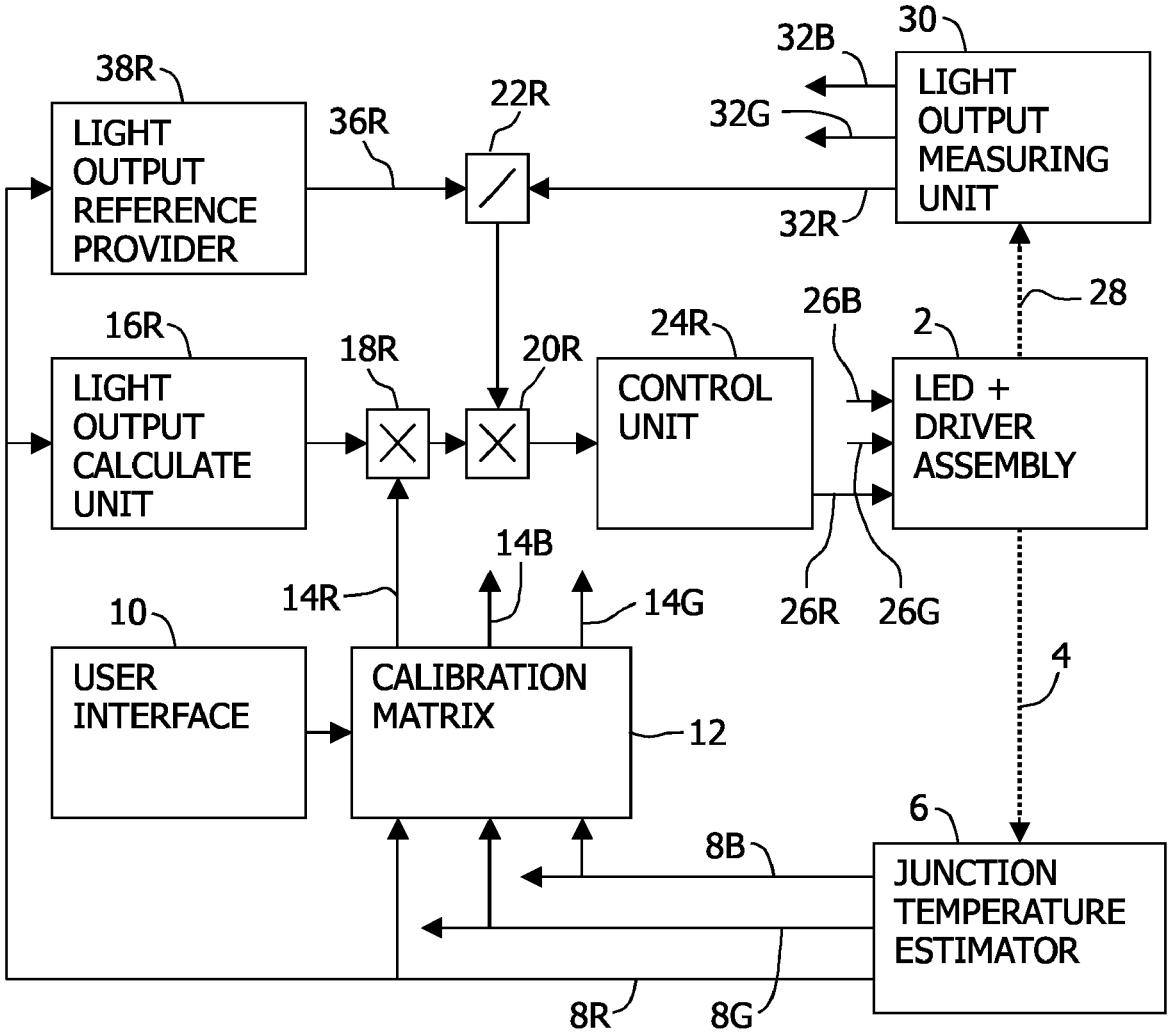
FIG. 2 shows a diagram of a second embodiment of a lighting system according to the invention.

The second embodiment of a lighting system according to the invention shown in FIG. 2 differs from the first embodiment shown in FIG. 1 by that the light output reference provider 34R is replaced by a light output reference provider 38R, which is supplied with the junction temperature value 8R. The light output reference provider 38R calculates the light output reference value 36R dependent on the junction temperature value 8R. While light output reference provider 34R of the first embodiment was static, light output reference provider 38R of the second embodiment requires carrying out additional calculations. However, since the additional calculations must be carried out with the long second interval they do no represent a significant load for the processor.

Briefly said, a method for controlling an arrangement of light emitting semiconductors for emitting light of different distinct colors and a lighting system, which is in accordance with that, are provided, in which a junction temperature feed forward control part operating with a short first interval is adjusted dependent on measured light output values with a much longer second interval.

Preferably, adjustments of the temperature dependent control loop by the light output control loop is carried out each time the lighting system is switched on. It need not be carried out completely during a single first interval, but it may span several first intervals.

The second interval can be started when the lighting system is switched on for the first time or with each switching on of the lighting system.

The invention claimed is:

1. A method for controlling an arrangement of light emitting semiconductors, which include semiconductors emitting light of substantially distinct colors, comprising:

providing target intensities and a target intensity ratio of emitted light of different colors;

controlling the semiconductors dependent on a semiconductor junction temperature for each color, whereby the junction temperatures are determined by a measured temperature in the system;

controlling the semiconductors dependent on light output feedback of emitted light for each color to achieve a total light emission which is identical to a reference total light emission, wherein the steps of temperature dependent controlling and the light output dependent controlling are carried out with different first and second intervals, of which the second interval is more than a thousand times longer than the first interval during continuous light emission by the semiconductors, and, wherein, for each distinct color, the temperature dependent controlling is adjusted dependent on a ratio of a light output reference value and a light output feedback value, which is determined with said second intervals.

2. Method according to claim 1, wherein the light output dependent controlling is carried out at a start of light emission by the semiconductors.

3. Method according to claim 1, wherein the second interval is started at a start of light emission by the semiconductors.

4. Method according to claim 1, wherein the second interval has a duration which is in a range of 100 to 10000 hours.

5. Method according to claim 1, wherein, for each color, the light output reference value is determined dependent on a determined junction temperature value.

6. Lighting system, comprising an arrangement of light emitting semiconductors, which include semiconductors emitting light of substantially distinct colors, a supply part for supplying power to the semiconductors and a controller for controlling the supply part in order to achieve a total light emission which is identical to a reference total light emission, whereby the controller comprises means for determining a junction temperature of the semiconductors, means for setting nominal intensity values of emitted light for each distinct color at a reference junction temperature of the semiconductors in accordance with a predetermined nominal color ratio of emitted light, and for adjusting the nominal intensities dependent on the determined junction temperatures to achieve the predetermined nominal color ratio, and, for each distinct color, means for calculating an output power value of emitted light at the determined junction temperature, and a first multiplier for multiplying the intensity value and the calculated output power value to provide a control signal for the supply part for the distinct color with first intervals, and further comprising an output control part, which has means for measuring the emitted light and for determining a light output value of emitted light for each distinct color, and, for each distinct color, adjusting the control signal in order to make the determined light output value identical to a reference light output value, wherein, for each color, the light output is determined with a second interval, which is more than a thousand times longer than the first interval, the determined light output value is stored during the second interval, and there is provided a second multiplier, which multiplies the control signal by a ratio of the reference light output value and the determined light output value.

7. Lighting system according to claim 6, wherein the light output of emitted light and the light output ratio are determined at a start of light emission by the semiconductors and the control signal is multiplied by said ratio.

8. Lighting system according to claim 6, wherein the second interval is started at a start of light emission by the semiconductors.

9. Lighting system according to claim 6, wherein the second interval has a duration, which is in a range of 100 to 10000 hours.

10. Lighting system according to claim 6, wherein, for each color, the light output reference value is determined dependent on a determined junction temperature value.

* * * * *